US005085007A

United States Patent [19]

Tusinski

[11] Patent Number: 5,085,007

[45] Date of Patent: Feb. 4, 1992

[54] TORIC LENS FINING APPARATUS

[75] Inventor: Joseph Tusinski, Muskogee, Okla.

[73] Assignee: Coburn Optical Industries, Muskogee, Okla.

[21] Appl. No.: 405,224

[22] Filed: Sep. 11, 1989

[51] Int. Cl.[5] ..... B24B 7/00

[52] U.S. Cl. ..... 51/55; 51/124 L

[58] Field of Search ..... 51/284 R, 55, 126, 124 R, 51/124 L, 58

[56] References Cited

U.S. PATENT DOCUMENTS

| | | | |
|---|---|---|---|
| 2,371,303 | 3/1945 | Liebowitz | 51/55 |
| 2,977,724 | 4/1961 | Kennedy et al. | 51/55 |
| 3,900,972 | 8/1975 | Rupp | 51/124 L |
| 4,172,338 | 10/1979 | Kojo et al. | 51/124 L |
| 4,521,994 | 6/1985 | Tusinski | 51/67 |
| 4,574,527 | 3/1986 | Craxton | 51/55 |
| 4,656,788 | 4/1987 | Rhoades et al. | 51/55 |
| 4,907,373 | 3/1990 | Hunter et al. | 51/58 |

*Primary Examiner*—M. Rachuba

*Attorney, Agent, or Firm*—Bradford E. Kile

[57] ABSTRACT

A fining apparatus to finish the surface of an ophthalmic toric lens including a frame, a compound arcuate tool, a lens holding assembly, a motor for driving the tool in an orbital motion and the operative length of the tool is defined by the equation $L=1/k\theta$ for a half angle of orbit excursion $\theta$ between 0.25 and 2.25 degrees.

5 Claims, 6 Drawing Sheets

TORIC LENS FINING APPARATUS

RELATED PATENT

This application relates to applicant's prior application entitled TORIC FINER-POLISHER, U.S. Serial No. 07/111,029, now U.S. Pat. No. 4,907,373, of common assignment with the instant application.

BACKGROUND OF THE INVENTION

This invention generally relates to a toric lens finer-polisher. More specifically, this invention relates to a novel apparatus for the fining and/or polishing of ophthalmic toric lenses.

In ophthalmic optics, lens blanks are formed from glass or plastic, and a convex or concave surface of the lens is mounted upon a retaining member known as a lens block. The lens and block are then accurately mounted upon a grinding apparatus wherein a toroidal surface of compound prescriptive value is "rough ground" into a concave portion of the lens. In this regard, a first principal meridian of the lens typically has a different dimension with respect to a second principal meridian normal to the first. Following the initial grinding operation, an ophthalmic lens is fined and then polished to a final prescriptive value. Left and right lenses are then mounted upon an edge grinding machine to cut the outer peripheral shape required for compatability with an eyeglass frame of an ultimate user or wearer.

The basic concept governing implementation of a machine which finishes lenses provides a means of holding a toric tool and a lens to be finished in intimate contact. The tool and lens are driven such that relative motion between the lens and the tool furnishes a degree of abrasion required for fining and polishing the lens. For those skilled in the art, it is understood that the ancillary materials of coolants, abrasives and polishes are necessary for the process and will not be discussed herein.

An early device in the lens finishing industry included cylindrical lens finishers in which the toric surface of a lapping tool was held in engagement with the lens surface and moved relative thereto in a path referred to as a "break-up" motion. Such break-up movement prevents ridges, grooves and other aberrations from being formed in the lens surface, such ridges, grooves and aberrations occurring when regular or uniform motion is utilized. In addition to orbital, break-up motion of the lapping tool, the aforementioned device discloses movement of the lens in a transverse motion from side to side.

Although finer-polisher systems of the type previously described were widely utilized, room for significant improvement remained. For example, systems such as that disclosed suffered from relatively lower speed of motion between the lapping tool and the lens, and any attempt to increase the relative speed of motion between the lapping tool and the lens caused a sacrifice in the lens finishing ability of the system. It was also considered desirable to be able to easily vary the amplitude of the orbital, break-up motion of such a system.

In order to overcome disadvantages of the previously described system, a finer/polisher machine was developed in which first and second assemblies were provided for carrying a lapping tool and a lens, respectively, and for imparting an orbital break-up motion during the fining and polishing operation. The amplitude of orbital movement in this arrangement was variable by application of a cam assembly for adjustment of the degree of orbital break-up motion of the lens mounting and/or lapping tool. However, there was also a disadvantage with this system in that it was not possible to decrease the speed and amplitude of motion of a lens lapping tool for enhanced control, while at the same time maintaining a high degree of relative motion between a lens and the tool to facilitate rapid fining and polishing. It was also considered desirable to have a system for achieving motion in an X-Y plane which would eliminate any tendency for the creation of a sawtooth aberration on the lens. Elimination of these problems was thought to be desirable because the rate of finishing of an ophthalmic lens could be increased without sacrificing lens finishing quality of the system.

Accordingly, a further finer-polisher device was developed in which a frame and gimbal-mounted assembly for providing an orbital break-up motion to a lens lapping tool, in combination with an X-Y motion assembly connected to the frame and lens, provided a smooth, Lissajous figure movement to the lens. In the X-Y motion assembly, commonly driven first and second cams provide movement in the X and Y directions, respectively.

In general, in break-up motion devices used with cylindrical lens surfaces, the base and cross-curve of the lapping tool must be maintained in parallel relationship with respect to the base and cross-curve of the lens. The finer-polisher machines previously mentioned employed a gimbal assembly mounted between a pair of brackets extending outwardly from a sidewall of the machine. The gimbal assembly was located a relatively short distance, as measured along a tool shaft, from the top of the lapping tool. The gimbal prevents rotation of the tool shaft about its own longitudinal axis. This is important because the cylindrical surface of the lapping tool must be maintained in accurate rotational alignment with the surface of the lens to be finished.

The relatively short length of the tool shaft from the gimbal to the tool holder, however, has posed problems. For example, lens hydroplaning and excessively long strokes of the tool have resulted. More specifically, certain portions of the lens surface will not polish; typically, these areas or zones are obliquely disposed from the cylindrical axis of the lens, and are referred to as "grey" areas.

As a result of the deficiencies previously mentioned, complex break-up motions have been required, especially in order to cope with some of the idiosyncrasies of the machines. More and more complex break-up motions have tended to reduce some of the problems. However, such complex motions have had the disadvantage of adversely influencing the integrity of the lens surface radii, which in turn has degraded optical integrity. In some cases, rubber supports have been used in order to compensate for this problem by allowing the tool to move or rotate off-axis. However, this has created a serious flaw in axis integrity which, in some cases, has followed an "S" path instead of a straight line, as desired.

An improved device addressed the problems previously encountered due to a relatively short tool shaft length from the gimbal to the tool holder, relative to the orbit of the shaft, by suggesting use of a longer tool shaft. By using a longer tool shaft, the tendency to skew with tool excursion in an oblique direction was minimized.

While the general observation that a relatively longer tool shaft enhances the finer-polisher operation is significant, room for worthwhile improvement remains regarding optimization of operation. In this regard it would be desirable to specifically describe an optimal shaft length such that the finer-polisher configuration produces a minimum disparity between the tool and lens axes that may be tolerated to yield high quality optical surfaces in a relatively short amount of time.

The difficulties and desire for further improvement suggested in the preceeding are not intended to be exhaustive but rather are among many which may tend to reduce the effectiveness of prior lens finer-polisher devices. Other noteworthy concerns may also exist; however, those presented above should be sufficient to demonstrate that toric lens finer-polishers appearing in the past will admit to worthwhile improvement.

OBJECTS AND BRIEF SUMMARY OF THE INVENTION

Objects

It is therefore a general object of the invention to provide a novel apparatus for finishing toric ophthalmic lenses which will obviate or minimize difficulties of the type previously described.

It is a specific object of the invention to describe a polisher-finer apparatus for enhancing the manner in which the oblique surfaces of an ophthalmic toric lens are finished.

It is another object of the invention to provide a polisher-finer apparatus wherein the angular orbit excursion from a tool shaft is minimized.

It is still another object of the invention to empirically describe a tool shaft length which will optimize the lens finishing operation.

It is a further object of the invention to provide a pragmatic range for parameters associated with a polisher-finer apparatus such that optimal performance may be obtained.

It is yet a further object of the invention to provide a polisher-finer apparatus in which the efficiency of lens finishing is enhanced.

BRIEF SUMMARY OF A PREFERRED EMBODIMENT OF THE INVENTION

A preferred embodiment of the invention which is intended to accomplish at least some of the foregoing objects include a frame and a tool carrying assembly connected to the frame by a gimbal mounting at one end and carrying a tool having a compound arcuate surface at the other end. The tool carrying assembly, hereinafter referred to as the tool shaft, is driven in an orbital motion about its initial axis by a motor.

Contact between the surface of an ophthalmic toric lens and the tool is such that the base and cross-curve of the tool remain parallel to the base and cross-curve of the lens at the common point of contact. Relative motion between the tool and the lens surfaces produces the frictional force which polishes the lens. The lack of universal movement of the tool shaft with respect to the surface of an ophthalmic toric lens is overcome by lengthening the tool shaft such that the physical constraints of the gimbal mounting are rendered negligible. The tool can then maintain its parallel relationship with the surface of a toric ophthalmic lens in the oblique areas of the lens, thus increasing the optical integrity of the lens in those areas.

Within the scope of this invention are equations which specify an optimal tool shaft length and incorporate parameters for the orbit excursion and the angle of orbit excursion. The collective effect of the subject invention yields an ophthalmic toric lens polisher which yields high integrity lenses within a relatively short amount of time.

THE DRAWINGS

Other objects and advantages of the present invention will become apparent from the following detailed description of a preferred embodiment thereof taken in conjunction with the accompanying drawings, wherein.

DETAILED DESCRIPTION

Context of the Invention

Figure 1:
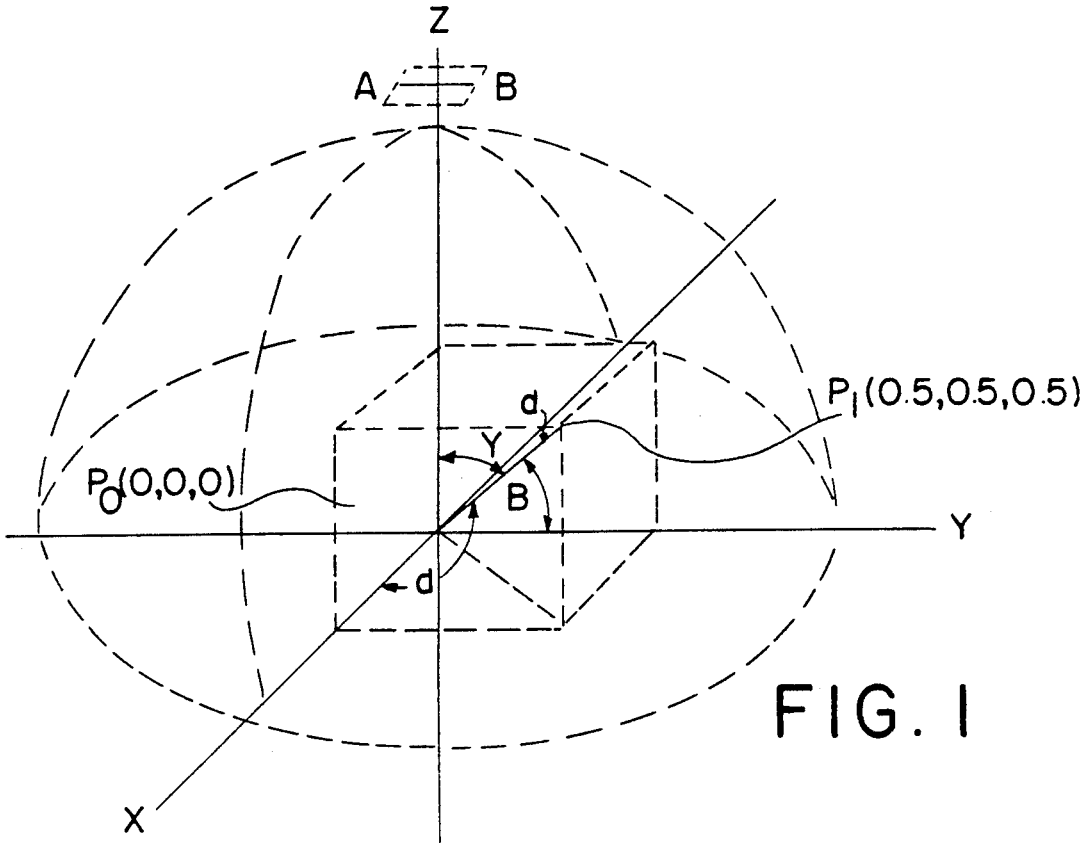
FIG. 1 is an illustration relating to the movement of a tool in a non-oblique manner within a hemispheric envelope.

An understanding of the operative context of the present invention will be facilitated by referring to applicant's prior related patent, identified above, the disclosure of which is incorporated by reference as though set forth at length herein. Briefly, however, FIGS. 1, 2, 3, and 4, disclose the basic structural components of a finer-polisher apparatus. Referring now to the drawings, wherein like numerals indicate like parts, and initially to FIG. 1, there will be seen an illustration used to describe the movement of a tool in a non-oblique manner within its hemispheric envelope. Point $P_O$ (O,O,O) represents the origin of an X-Y-Z axis system and the centric of the hemispheric envelope created by tracing point $P_1$ throughout its convolutions, the point $P_1$ being located a distance d from the origin $P_O$. For illustrative purposes, "d" is defined as having a unity radius, and P occupies the position of a gimbal with free axes in the X-Y meridians. Certain mechanical restrains prevent Pl from inscribing the total hemisphere, but this should not detract from an understanding of the principles explained herein.

In FIG. 1, the line A-B represents the cylindrical axis of a tool within a tool plane which is always perpendicular to the radius arm "d" regardless of its position in the hemispheric envelope. It can be intuitively surmised that, if "d" is moved by rotation around the X-axis, the tool axis A-B will remain parallel to the Y-Z plane and perpendicular to the X-Z plane. Similarly, if "d" is rotated about the Y-axis, tool axis A-B remains parallel to the Y-Z plane and perpendicular to the X-axis when the tool axis A-B is projected into the X-Y plane.

Figure 2:
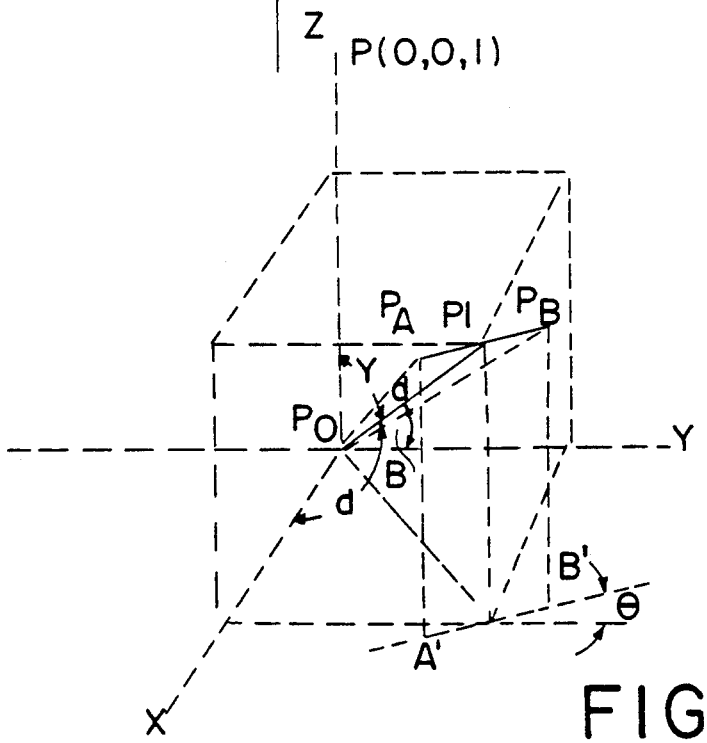
FIG. 2 is another illustration used to explain problems created movement of a tool within the hemispheric envelope.

FIG. 2 is a further illustration used to demonstrate the latter point. The radius arm (corresponding to the shaft of a tool) "d" has been moved to an oblique position having an angular displacement of 45° with respect to the X, Y, and Z axes. In such a position, the tool axis (A-B in FIG. 1) occupies a position corresponding to points $P_A$, $P_1$ and $P_B$ (in FIG. 2). Presuming that the coordinates of point $P_1$ are (0.5, 0.5, 0.5), when the tool axis is projected into the X-Y plane, the projected line A'-B' is no longer parallel to the Y-axis, there being an angle $\theta$ between the line A'-B' and the Y-axis. The areas on the lens between the projected axis A'-B' and the Y-axis not in parallel positioning are referred to as the oblique, or "grey", areas. In this regard, it is necessary to iterate that the tool shaft "d" is constrained by gimbal bearings from rotating around the X and Y axes, such that the tool does not completely contact the "grey" areas. This restraint is imposed on the tool shaft "d" by the mechanism driving the tool shaft "d" and by the fact that the distal tool shaft is restrained by the physical size of the gimbal associated with it.

Figure 3:
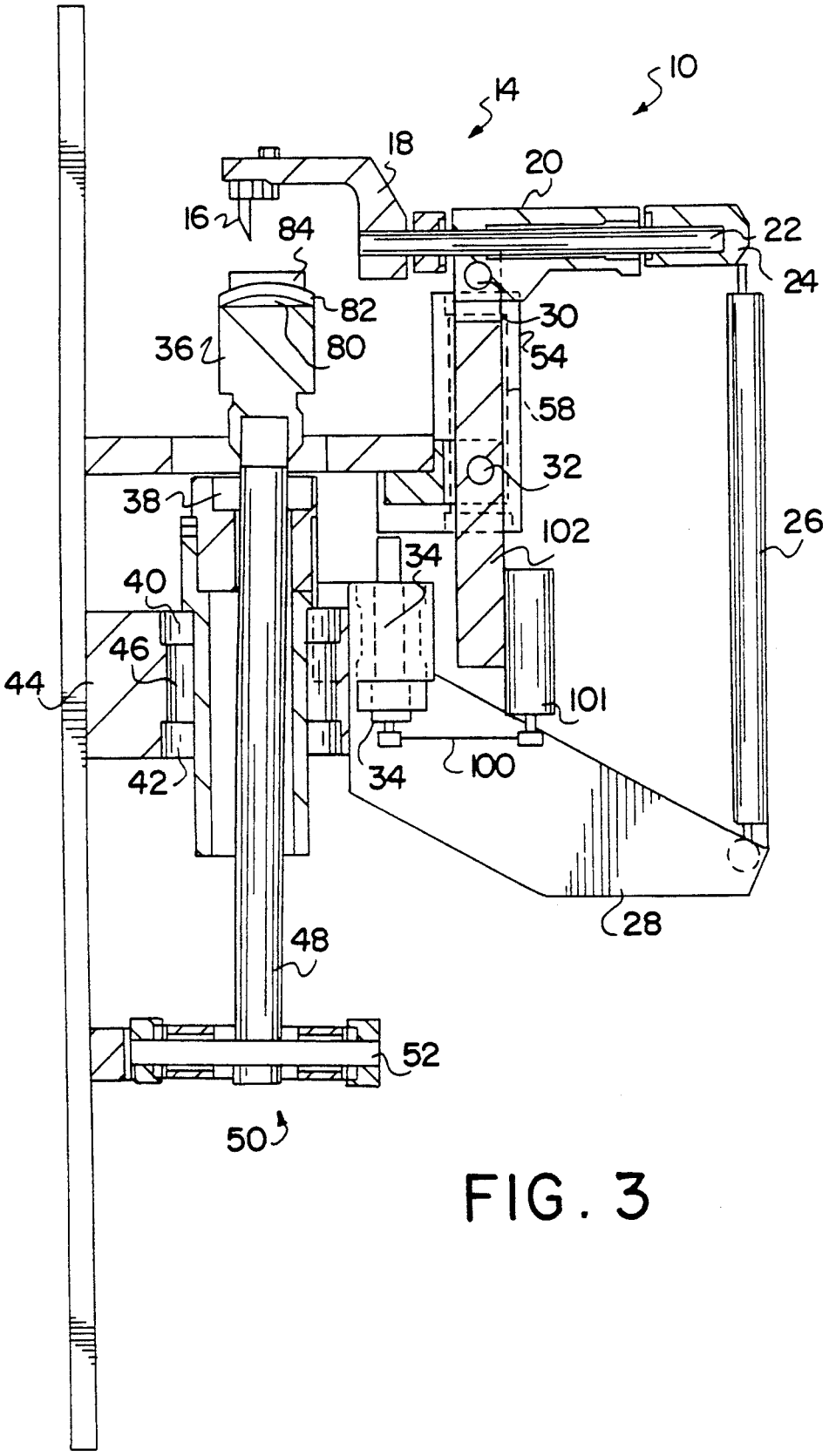
FIG. 3 is a side elevational view, partially in section, of a toric finer polisher arrangement relating to the present invention.
Figure 4:
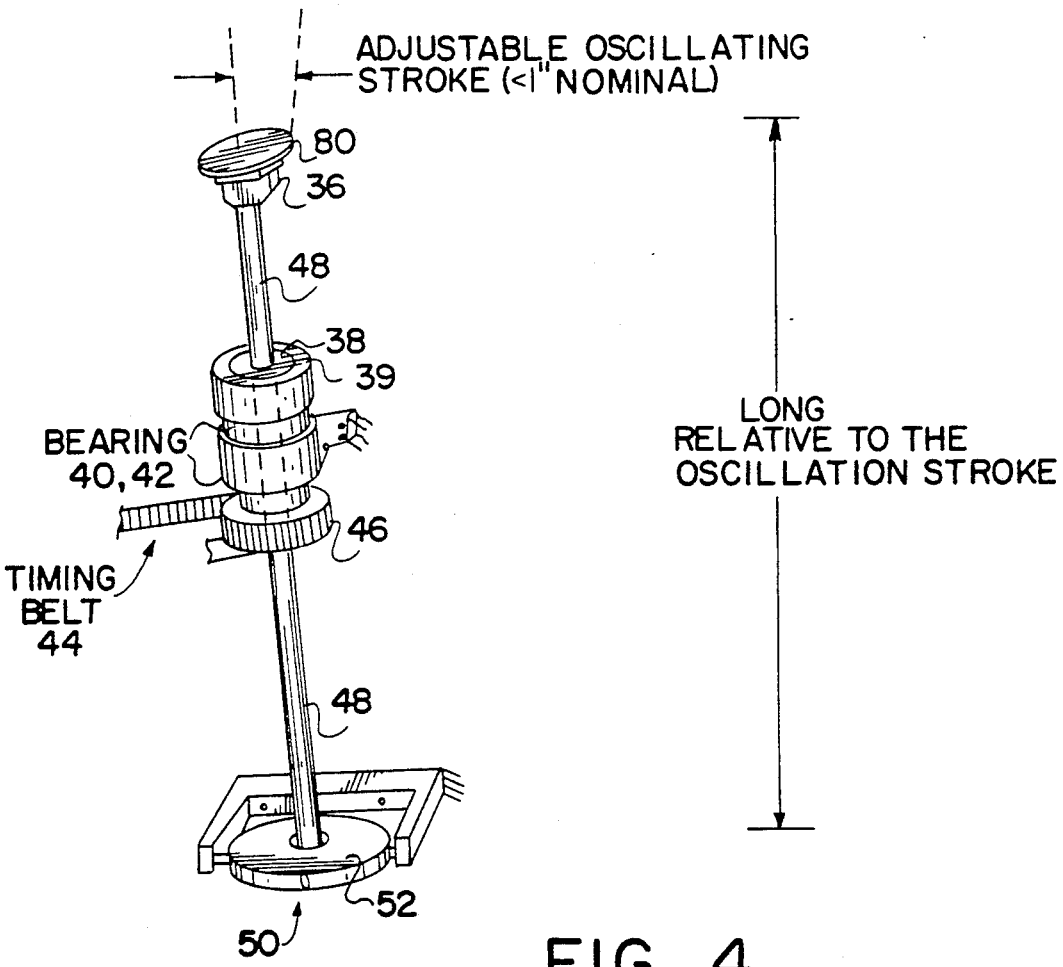
FIG. 4 is a perspective view of a lap table and its component moving parts within the toric finer polisher arrangement relating to the present invention.

Referring to FIG. 3 and 4, a toric finer-polisher 10 is understood to include a lefthand section 12 and a righthand section 14. Since the lefthand and righthand arrangements 12 and 14, respectively, are identical in every respect, only the righthand arrangement 14 will be described.

The righthand arrangement 14 of the toric finer-polisher 10 includes the following elements: polishing pins 16, rocker arm 18, rocker arm holder 24, air cylinder 26, bracket 28, pins 30 and 32, rotary eccentric 34, lap table 36, spherical bearing 38, bearing holder 39, upper bearing 40, lower bearing 42, timing belt 44, timing belt pulley 46, shaft or spindle 48, E-mounting plate 50, and axis plate 52.

All motions in the toric finer-polisher are driven by a single motor (not shown). Lap table 36 acts as a tool holder for holding a lapping tool 80, on top of which a lens 82 to be fined/polished is mounted. A block 84 is mounted on top of the lens 82. When a fining-polishing operation is to be carried out, pins 16 are lowered into contact with the upper surface of block 84 by actuation of air cylinder 26. Specifically, air cylinder 26 is operated to raise the rocker arm holder 24, thus lowering the pins 16 so that the pins 16 are positioned in depressions (not shown) in the upper surface of block 84. Shaft 48 is constrained from rotating by plate 52.

Break-up or X-Y motion is achieved and translated to the lens 82 in accordance with the foregoing toric-finer polisher 10. A Lissajous pattern similar to that disclosed and discussed in U.S. Pat. No. 4,521,994—Tusinski is hereby incorporated by reference as though set forth at length and will not be discussed herein.

FIG. 4 illustrates the long shaft 48 length relative to the oscillating stroke of the shaft. In one embodiment, the oscillating assembly is located between the lapping tool 80 and the gimbal mounting assembly. In another embodiment, the gimbal assembly may be located between the lapping tool 80 and the oscillating assembly without departing from the concepts underlying the basic operation of the toric-finer polisher.

Optimization of Shaft Length

Figure 5:
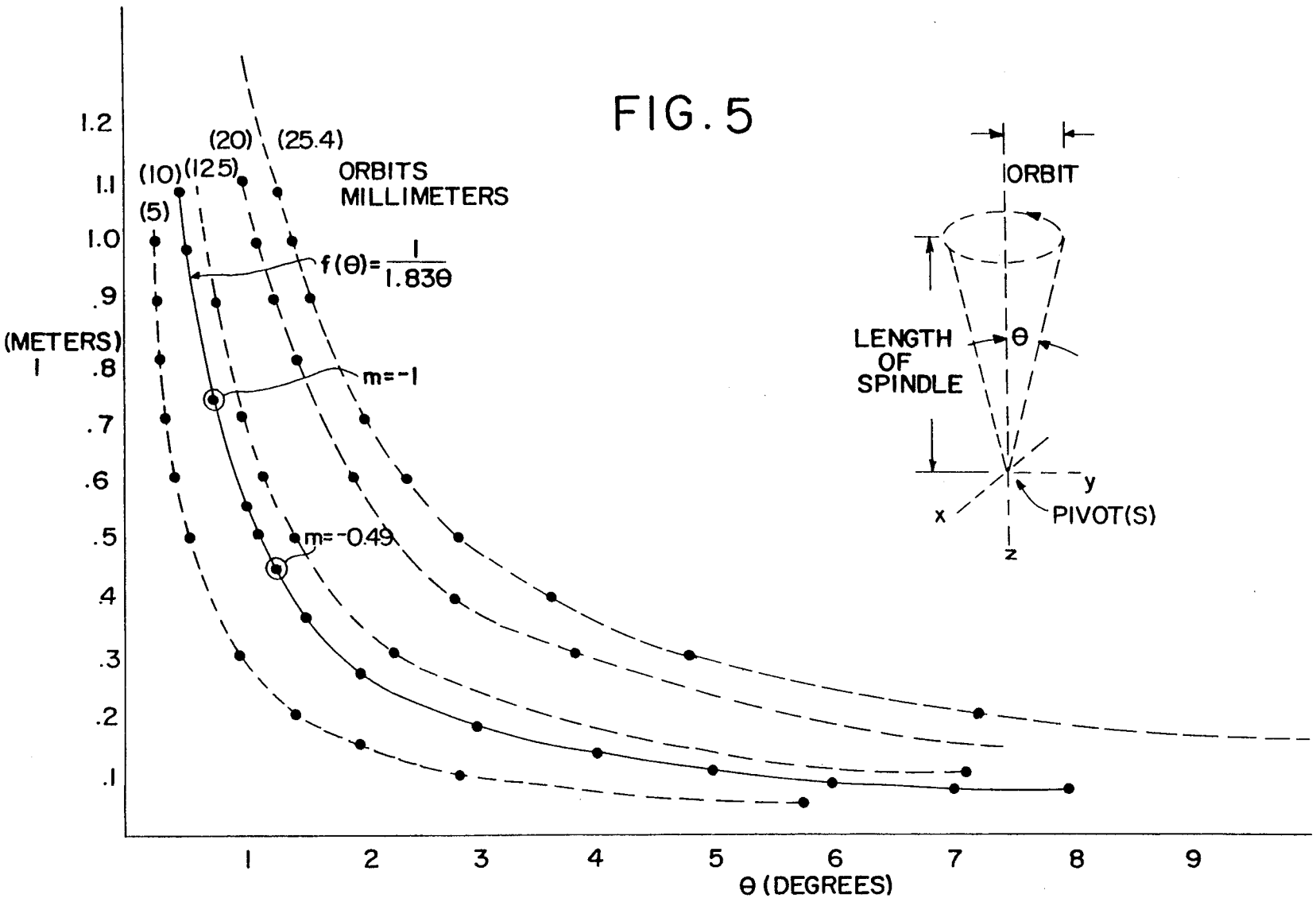
FIG. 5 is a graph of the length of a tool shaft versus the angle of excursion of the subject toric lens finer-polisher to various orbit distances.

FIG. 5 includes a graph, which illustrates the significant parameters relating to the orbit of a tool shaft about its axis, and a schematic view of the shaft axis, similar to FIG. 4. On the graph, the abscissa is $\theta$, the shaft to axis angle measured in degrees, and the ordinate is the length L of the tool shaft measured in meters. The point at the intersection of the X, Y, and Z axes, labelled $P_o$, corresponds to the attachment of a tool shaft to a gimbal in the common configuration of a lens finer-polisher device. Rotation of the distal end of the tool shaft, connected to a tool, about its axis produces a conical outline of the tool shaft movement, as shown in FIG. 5. The orbit B of the tool shaft L is defined as the distance from one extreme edge of excursion to the initial and substantially vertical position of the shaft, shown as the Z axis.

Also shown in FIG. 5 is a plot of geometrically determined data relating the orbit excursion B, half angle of orbit excursion $\theta$, and the corresponding length of the tool shaft L which produces such excursions $\theta$ and B. Typically, the unit for orbit excursion B is millimeters and the length of the tool shaft L is in meters; FIG. 5 is labelled accordingly. The half angle of orbit excursion of the tool shaft $\theta$ from its initial, generally vertical, position, is measured in degrees.

For the system of plots shown, it has been empirically determined that the plots may be generally described by the equation $L=1/k\theta$, where L and $\theta$ are as defined above, and k is a constant dependent upon the orbit excursion B. The value of k for a specific orbit is determined from the equation $k=2/B$, where B is the orbit excursion measured in millimeters. For example, for B=10 mm (Graph 1), the value of k is 1.83. Therefore, to obtain the shaft length for B=10 mm and an acceptable half-angle of orbit excursion, values are substituted into the equation $L=1/1.83\theta$, and a corresponding shaft length L is determined.

It has been experimentally determined that for an average size ophthalmic toric lens to be polished, an orbit excursion of approximately 10 mm gives a high integrity surface in a relatively short amount of time. Accordingly, an orbit excursion of 10 mm is optimal. The plot of a 10 mm orbit excursion is darkened on the graph in FIG. 5.

From the plots in FIG. 5, it can be seen that as the length of the tool shaft increases for a constant orbit excursion length B, the half angle of orbit excursion $\theta$ decreases. Theoretically, an infinitely long tool shaft would be most desirable and would produce an angular shaft disposition approaching zero. However, the mechanical constraints of such a long shaft are prohibitive.

Figure 6:
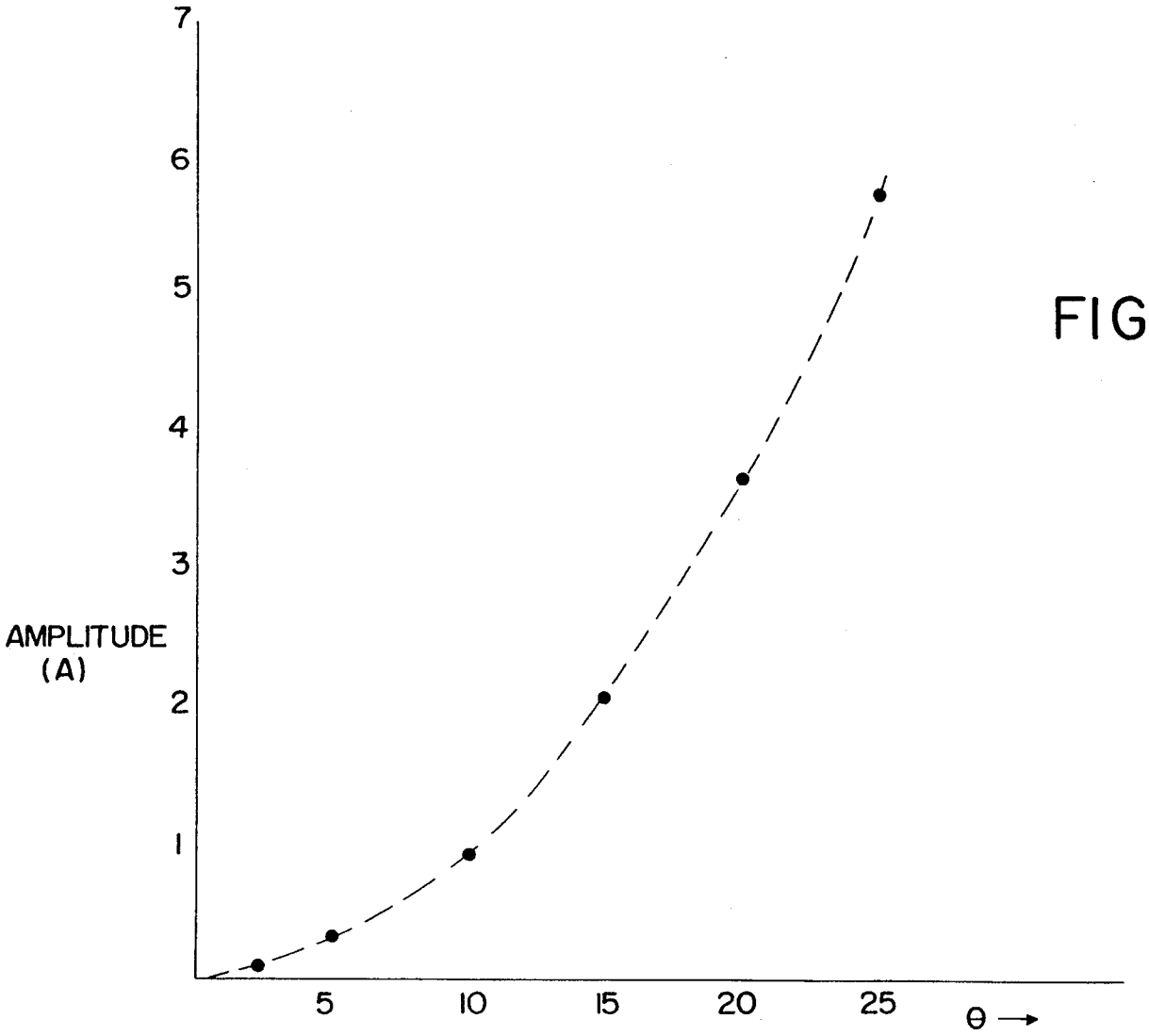
FIG. 6 is a graph relating how the maximum angular difference between the tool and the lens axis of the subject toric lens finer-polisher varies as a function of the orbiting shaft angle.

Referring specifically to FIG. 6, shown is a plot of the abscissa value of $\theta$ versus the ordinate value of the amplitude, A, of the error function. FIG. 6 relates how the angular difference between the tool surface and the toric ophthalmic lens surface varies as a function of the orbiting shaft excursion angle $\theta$. More specifically, as the tool traces a spherical outline, the difference between the spherical outline of the tool shaft and the toric surface of the lens increases as the angle of excursion increases. If the surfaces of the tool and the toric ophthalmic lens are not flush, the "grey" areas previously mentioned will result. For optimal finishing, this difference, or the amplitude, between the surface of the tool and the surface of the lens must be minimized. It has been empirically determined that the amplitude $A=\theta^2/108.89$, where $\theta$ is the half-angle of orbit excursion. This equation is plotted in FIG. 6. The amplitude A is measured in degrees.

Figure 7:
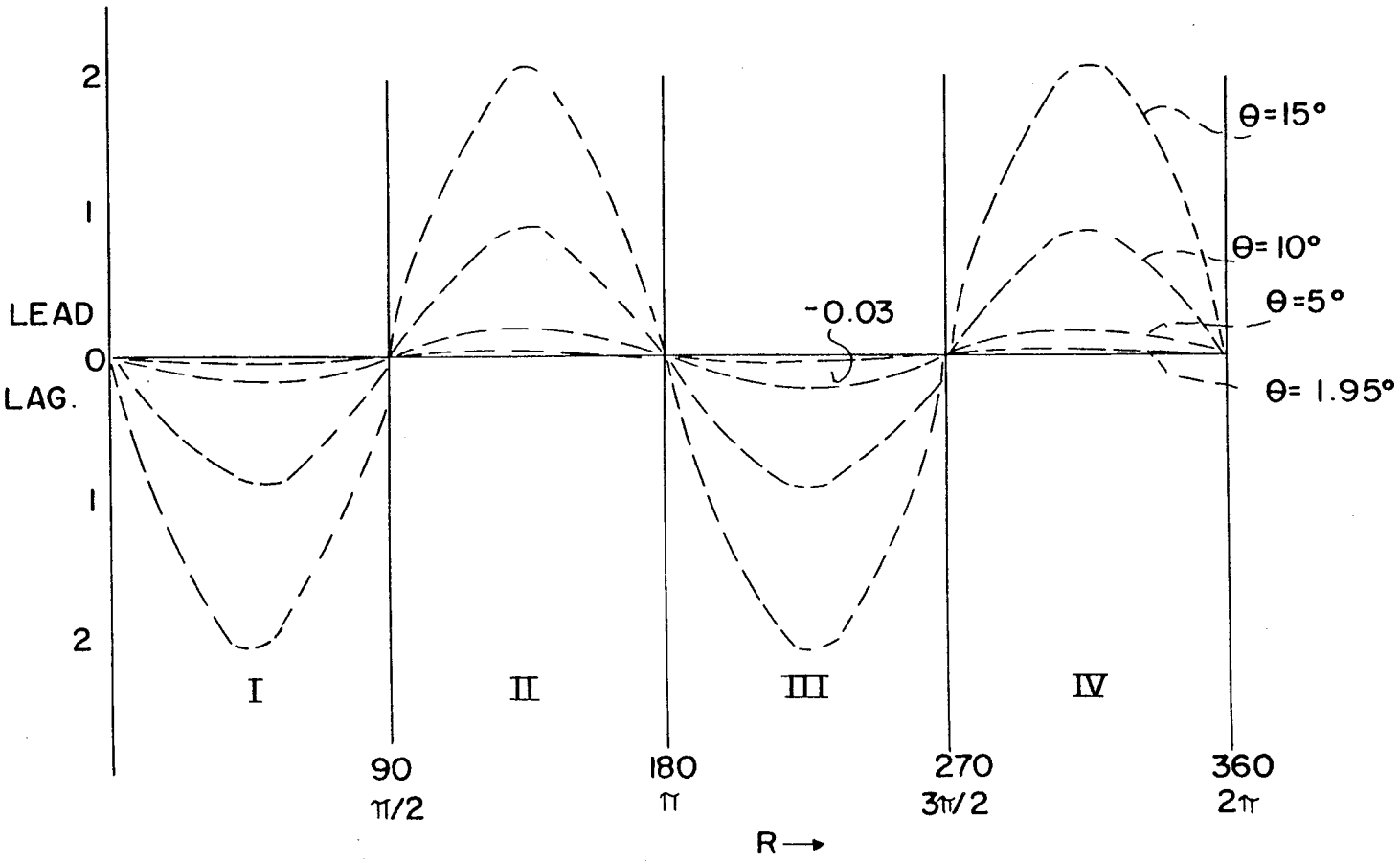
FIG. 7 is a graph illustrating the angular disparity for various shaft angles of the subject toric lens finer-polisher.

A toric ophthalmic lens to be finished generally has four oblique, or "grey", areas. For each quadrant of the lens, a sinusoidal lagging and leading twisting of the tool shaft takes place due to a disparity between the axes of the tool and the toric lens, as previously described. This twisting is the direct cause of inadequate finishing. The amplitude of the difference between the lens surface and the tool surface (FIG. 6) may be related to an angular error function by the equation $E=\theta^2(\sin 2B)/108.89$. This function is plotted on FIG. 7 and illustrates the angular disparity in each of the four quadrants for various shaft excursion angles $\theta$.

The four values of $\theta$ plotted illustrate that the error function decreases in magnitude with decreasing values of $\theta$. Therefore, to minimize the disparity between the tool surface and that of a toric ophthalmic lens at the oblique positions of the lens especially, a small value of $\theta$ is desirable. Ideally, the value of E would be equal to 0, corresponding to the horizontal axis in FIG. 7. However, an error value of $\theta$ corresponds to $\theta=0$, which is not feasible; the tool shaft must orbit, if even only to a relatively small degree, in order to finish the lens.

The desirable adaptation of the present invention is experienced when $L=1/k\theta$, with k optimally equal to 1.83. A reasonable range of values for k is determined from a corresponding range of orbit excursion values B which have been experimentally determined. The value of B depends upon the size of a lens to be finished, but an average value is 10 mm However, a range of values for B between 5 mm and 5.4 mm is feasible, and corresponds to a range of k values from 0.078 to 0.4. As explained above, the value of $\theta$, the half-angle of orbit excursion, should be kept to a minimum in order to minimize the effect of error associated with angular disparity between the surface of the tool and the surface of a toric ophthalmic lens to be polished. It has been experimentally determined that a value of $\theta$ equal to 1.25 degrees is optimal, but this value may range between 0.25 degrees and 2.25 degrees and produce a lens with a surface integrity acceptable in the lens fining industry.

After choosing acceptable values for excursion parameters $\theta$ and B, the corresponding tool shaft length may be determined from the formula $L=1/k\theta$, as described above. Choosing excursion values $\theta$ and B which lie in the ranges set forth above insures a tool shaft length which is mechanically feasible and a machine configuration allowing finishing of a toric ophthalmic lens within a reasonable amount of time relative to the prior art.

SUMMARY OF MAJOR ADVANTAGES OF THE INVENTION

After reading and understanding the foregoing description of the inventive apparatus for finishing a surface of an ophthalmic toric lens, in conjunction with the drawings, it will be appreciated that several distinct advantages of the subject invention are obtained.

Without attempting to set forth all of the desirable features of the instant apparatus for finishing a surface of an ophthalmic toric lens, at least some of the major advantages of the invention include the tool shaft length being described by the equation $L=1/k\theta$. Utilization of this equation minimizes the effects of skewing of the tool shaft by having a relatively long tool shaft length relative to the oscillating stroke of a tool.

The range of values for the orbit excursion B is between 5 millimeters and 25.4 millimeters, with an optimal value of 10 millimeters. This insures that the quality of the polished surface of an ophthalmic toric lens will be high relative to those produced by finer-polisher apparati of the prior art. Increased integrity will be effected especially in the oblique areas of the lens, and the lens finer-apparatus will also polish the entire lens within a relatively short amount of time. By empirically relating the orbit excursion B and the tool shaft length L, a lens finer-polisher apparatus may be realized which optimizes the motion of the tool shaft.

The inventive concept of relating the tool shaft length L and the orbit excursion B also allows construction of a lens finer-polisher apparatus with a specific tool shaft length such that an acceptable orbit excursion value is incorporated in design of the device. In this manner, the orbit excursion may be minimized and the oblique areas of an ophthalmic toric lens may be polished to a high degree of quality comparable to the rest of the surface of the lens.

In describing the invention, reference has been made to a preferred embodiment and illustrative advantages of the invention. Those skilled in the art, however, and familiar with the instant disclosure of the subject invention, may recognize additions, deletions, modifications, substitutions and other changes which will fall within the purview of the subject invention and claims.

What is claimed is:

1. An apparatus for finishing a surface of an ophthalmic toric lens comprising:

a frame;

tool carrying means for carrying a tool having a compound arcuate toric surface, said tool carrying means having, a tool axis and a first end at which the tool is disposed, and a gimbal mounting connected to said tool axis and said frame so that said tool axis has two orthogonal degrees of angular movement;

lens holding means connected to said frame for holding a lens in contact with the tool, the lens having a lens axis;

motor means connected to said frame for driving said tool carrying means in an orbital motion so as to cause the tool to move relative to the lens, thereby finishing the surface of the lens; and the length of said tool carrying means between said first end and said gimbal mounting being defined by the following equation. $L=1/k\theta$, wherein:

L=the length of said tool carrying means between said first end and said gimbal mounting, measured in meters k=a constant dependent upon the value of the orbit desired, and o=a half angle of orbit excursion of said tool carrying means measured in degrees comprise an angle between 0.25 and 2.25 degrees, this value minimizing the undesirable effect of angular disparity.

2. The apparatus for finishing a surface of an ophthalmic toric lens as defined in claim 1, wherein:

said constant k is dependent upon the value of the orbit excursion B, the distance from the tool shaft axis to the point of maximum excursion, of said tool carrying means, k being defined by the equation $k=1/B$.

3. The apparatus for finishing a surface of an ophthalmic toric lens as defined in claim 2, wherein:

orbit excursion B comprises a value between 5 millimeters and 25.4 millimeters, such a value being chosen dependent upon the size of an ophthalmic toric lens to be polished.

4. The apparatus for finishing a surface of a toric ophthalmic lens as defined in claim 3 wherein:

the range of values for said constant k is defined from 0.078 to 0.4, corresponding to said range of values for said orbit excursion B.

5. The apparatus for finishing a surface of a toric ophthalmic lens as defined in claim 4 wherein:

the length of said tool carrying means is defined by said range of values set forth for said constants k and B, such that a correspondingly configured finishing apparatus minimizes the effects of a tendency of said tool carrying means to skew in the oblique areas of an ophthalmic toric lens, wherein said length of said tool carrying means enabling said ophthalmic toric lens finishing apparatus to polish a lens rapidly and producing a finished lens with a high integrity surface.

* * * * *